US011639780B2

(12) United States Patent
Jeong

(10) Patent No.: US 11,639,780 B2
(45) Date of Patent: May 2, 2023

(54) LAMP FOR VEHICLE AND VEHICLE INCLUDING SAME

(71) Applicant: HYUNDAI MOBIS CO., LTD., Seoul (KR)

(72) Inventor: Hae Kwang Jeong, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/230,933

(22) Filed: Apr. 14, 2021

(65) Prior Publication Data

US 2021/0325015 A1 Oct. 21, 2021

(30) Foreign Application Priority Data

Apr. 16, 2020 (KR) ..... 10-2020-0046197

(51) Int. Cl.

| | |
|---|---|
| ***F21S 41/25*** | (2018.01) |
| ***F21S 41/148*** | (2018.01) |
| ***F21S 41/40*** | (2018.01) |
| *F21Y 115/10* | (2016.01) |
| *F21W 102/13* | (2018.01) |
| *F21W 107/10* | (2018.01) |

(52) U.S. Cl.

CPC ..... *F21S 41/25* (2018.01); *F21S 41/148* (2018.01); *F21S 41/40* (2018.01); *F21W 2102/13* (2018.01); *F21W 2107/10* (2018.01); *F21Y 2115/10* (2016.08)

(58) Field of Classification Search

None

See application file for complete search history.

(56) References Cited

U.S. PATENT DOCUMENTS 9,714,747 B2 7/2017 Tsukamoto
2013/0083553 A1* 4/2013 Sekiguchi ..... B60Q 1/0029 362/517

(Continued)

FOREIGN PATENT DOCUMENTS

EP 3 366 982 8/2018
EP 3366982 A1 * 8/2018 ..... F21S 41/147

(Continued)

OTHER PUBLICATIONS

Japanese Office Action dated May 24, 2022 issued in JP 2021-069990.

(Continued)

*Primary Examiner* — Elmito Breval

(74) *Attorney, Agent, or Firm* — DLA Piper LLP (US)

(57) ABSTRACT

Disclosed are a lamp for a vehicle and a vehicle including the lamp. One aspect of the present disclosure provides a lamp for a vehicle, the lamp including: a lens part configured as a single body capable of transmitting light and having a focal point; first and second light source parts configured to generate first light and second light that are to enter the lens part; an optic part provided in front of the second light source part; and a shield part configured to block a part of the first light or a part of the second light, in which the first light emitted from the first light source part and the second light emitted from the second light source part reach the single body of the lens part so as to form a beam pattern outside the vehicle.

12 Claims, 6 Drawing Sheets

(56) References Cited

U.S. PATENT DOCUMENTS

| | | | | |
|---|---|---|---|---|
| 2014/0016343 | A1* | 1/2014 | Brendle | F21S 41/255 362/516 |
| 2015/0323147 | A1* | 11/2015 | Kanayama | F21V 11/16 362/487 |
| 2016/0040848 | A1* | 2/2016 | Tsukamoto | F21S 41/68 362/509 |
| 2017/0227184 | A1* | 8/2017 | Ishida | F21S 41/36 |
| 2017/0276309 | A1* | 9/2017 | Nakazawa | F21S 41/24 |
| 2017/0276310 | A1* | 9/2017 | Nakazawa | B60Q 1/143 |
| 2019/0316749 | A1* | 10/2019 | Zorn | F21S 41/322 |

FOREIGN PATENT DOCUMENTS

| | | |
|---|---|---|
| JP | 2016-039020 | 3/2016 |
| JP | 2016-039110 | 3/2016 |
| JP | 2018-198160 | 12/2018 |

OTHER PUBLICATIONS

English Language Abstract of EP 3 366 982 published Aug. 29, 2018.
English Language Abstract of JP 2016-039020 published Mar. 22, 2016.
English Language Abstract of JP 2016-039110 published Mar. 22, 2016.
English Language Abstract of JP 2018-198160 published Dec. 13, 2018.

* cited by examiner

LAMP FOR VEHICLE AND VEHICLE INCLUDING SAME

CROSS-REFERENCE TO RELATED APPLICATION

This application claims priority to and the benefit of Korean Patent Application No. 10-2020-0046197 filed in the Korean Intellectual Property Office on Apr. 16, 2020, the entire contents of which are incorporated herein by reference.

TECHNICAL FIELD

The present disclosure relates to a lamp for a vehicle, and a vehicle including the lamp.

BACKGROUND ART

Headlamps are installed on left and right sides of a front portion of a vehicle and serve to ensure a driver's front visual field by emitting light to a location in front of the vehicle.

The headlamp may implement a low beam and a high beam by emitting light to the location in front of the vehicle to ensure the driver's front visual field while the vehicle travels at night. The headlamp may also implement daytime running light (DRL) for enabling other drivers or pedestrians to recognize the vehicle while the vehicle travels during the daytime.

Meanwhile, in the related art, a lamp module for implementing the low beam and the high beam and a lamp module for implementing the DRL are separately provided. Therefore, a light emitting surface of the headlamp when the low beam or the high beam is turned on differs from a light emitting surface of the headlamp when the DRL is turned on. For this reason, there are problems in that design characteristics and visibility of the headlamp deteriorate, the number of components required to configure the respective lamp modules is excessively large, and an overall volume of the headlamp also increases.

SUMMARY OF THE INVENTION

The present disclosure has been made in an effort to improve design characteristics and visibility of a headlamp.

The present disclosure has also been made in an effort to reduce a volume occupied by a headlamp and reduce the number of components required to configure lamp modules used to perform different functions.

In one aspect, the present disclosure provides a lamp for a vehicle, the lamp including: a lens part configured as a single body capable of transmitting light and having a focal point; a first light source part configured to generate first light that is to enter the lens part; a second light source part configured to generate second light that is to enter the lens part; an optic part provided in front of the second light source part and configured to concentrate the second light emitted from the second light source part and direct the second light to the lens part; and a shield part configured to block a part of the first light or a part of the second light, in which a region of an outer surface of the shield part, which faces the lens part, is provided between the lens part and the focal point of the lens part, and in which the first light emitted from the first light source part and the second light emitted from the second light source part reach the single body of the lens part so as to form a beam pattern outside the vehicle.

The second light source part may be provided below the focal point of the lens part.

The lamp may further include a reflector provided above the first light source part, in which at least a part of the first light emitted from the first light source part is reflected by the reflector and then enters the lens part, and in which at least a part of the second light emitted from the second light source part is concentrated by the optic part, exits the optic part, and then enters the lens part along an optical path directed straight.

The second light source part may be provided below the optic part.

The optic part may be provided below the focal point of the lens part.

The second light source part and the optic part may be provided below the shield part.

The focal point of the lens part may be formed at a position corresponding to the region of the outer surface of the shield part which faces the lens part.

The second light, which is emitted from the second light source part and enters the optic part, may have an optical path directed upward toward the lens part.

The second light source part may include a light emitting diode (LED).

A region of the second light source part in which the second light is generated and a region in which the optic part is provided may overlap the shield part when viewing the shield part from above the shield part.

The first light emitted from the first light source part may be light for forming a low beam, and the second light emitted from the second light source part may be light for forming daytime running light (DRL).

In another aspect, the present disclosure provides a vehicle including: a lamp for a vehicle, the lamp including: a lens part configured as a single body capable of transmitting light and having a focal point; a first light source part configured to generate first light that is to enter the lens part; a second light source part configured to generate second light that is to enter the lens part; an optic part provided in front of the second light source part and configured to concentrate the second light emitted from the second light source part and direct the second light to the lens part; and a shield part configured to block a part of the first light or a part of the second light, in which a region of an outer surface of the shield part, which faces the lens part, is provided between the lens part and the focal point of the lens part or provided on the focal point of the lens part, and in which the first light emitted from the first light source part and the second light emitted from the second light source part reach the single body of the lens part so as to form a beam pattern outside the vehicle.

The second light source part may be provided below the focal point of the lens part.

The first light emitted from the first light source part may be light for forming a low beam, the second light emitted from the second light source part may be light for forming daytime running light (DRL), and the second light source part may be turned off when the first light source part is turned on.

According to the present disclosure, it is possible to improve design characteristics and visibility of the headlamp.

In addition, according to the present disclosure, it is possible to reduce a volume occupied by the headlamp and reduce the number of components required to configure the lamp modules used to perform different functions.

BRIEF DESCRIPTION OF THE DRAWINGS

FIG. 5 is a side view illustrating a propagation direction of first light when a first light source part of the lamp for a vehicle according to the present disclosure is turned on.

FIG. 6 is a side view illustrating a propagation direction of second light when the second light source part of the lamp for a vehicle according to the present disclosure is turned on.

DETAILED DESCRIPTION

Hereinafter, a lamp for a vehicle and a vehicle according to the present disclosure will be described with reference to the drawings.

Lamp for Vehicle

Figure 1:
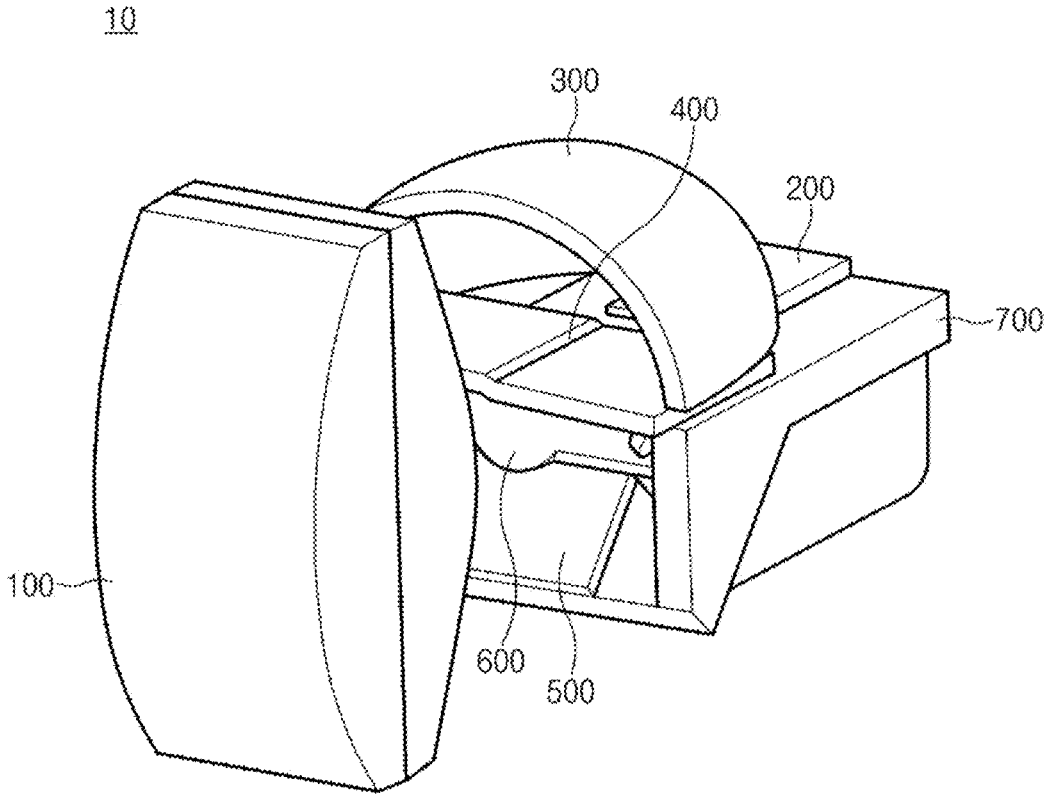
FIG. 1 is a perspective view illustrating a configuration of a lamp for a vehicle according to the present disclosure.
Figure 2:
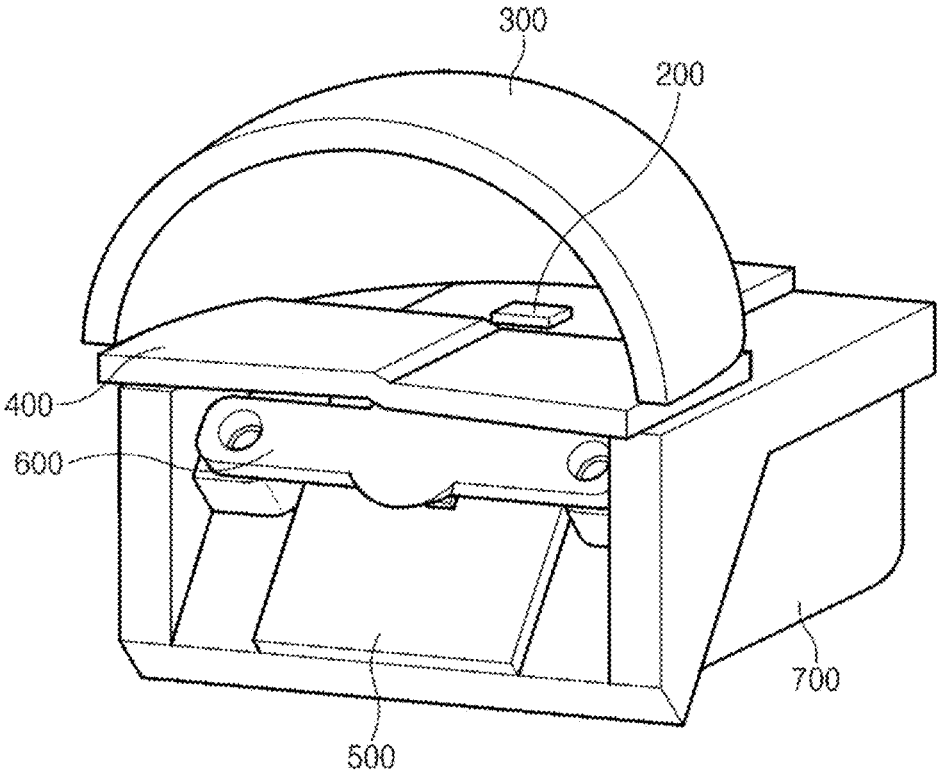
FIG. 2 is an enlarged perspective view illustrating components, except for a lens part, in the lamp for a vehicle according to the present disclosure.

FIG. 1 is a perspective view illustrating a configuration of a lamp for a vehicle according to the present disclosure, and FIG. 2 is an enlarged perspective view illustrating components, except for a lens part, in the lamp for a vehicle according to the present disclosure.

As illustrated in FIGS. 1 and 2, a lamp 10 for a vehicle (hereinafter, referred to as a 'lamp') according to the present disclosure may include a lens part 100 configured as a single body capable of transmitting light and having a focal point. In this case, the configuration in which the lens part 100 is configured as a single body may mean that components constituting the lens part 100 are integrally formed without being spaced apart from one another. For example, the lens part 100 may be an aspherical convex lens.

In addition, the lamp 10 may include a first light source part 200 configured to generate first light that is to enter the lens part 100, and a reflector 300 provided above the first light source part 200. The first light source part 200 may include a light emitting diode (LED) that generates the first light. At least a part of the first light emitted from the first light source part 200 of the lamp 10 according to the present disclosure may be reflected by the reflector 300 and then may enter the lens part 100, thereby forming a beam pattern outside the vehicle. Meanwhile, the first light emitted from the first light source part 200 may be light for forming a low beam of the vehicle.

In addition, the lamp 10 may further include a second light source part 500 configured to generate second light that is to enter the lens part 100, and an optic part 600 provided in front of the second light source part 500 and configured to concentrate the second light emitted from the second light source part 500 and direct the second light to the lens part 100. In addition, the second light source part 500 may include an LED that generates the second light. In the lamp 10 according to the present disclosure, at least a part of the second light emitted from the second light source part 500 may be concentrated by the optic part 600 and then may enter the lens part 100, thereby forming a beam pattern separately from the beam pattern formed by the first light. Meanwhile, the second light emitted from the second light source part 500 may be light for forming daytime running light (DRL) of the vehicle. In this case, the DRL is turned on while the vehicle travels during the daytime, and the DRL may allow other drivers or pedestrians to recognize the vehicle.

Continuing to refer to FIGS. 1 and 2, the lamp 10 may further include a shield part 400 configured to block a part of the first light emitted from the first light source part 200 or a part of the second light emitted from the second light source part 500. The shield part 400 may be configured to block a part of the first or second light to determine a shape of a beam pattern formed outside the vehicle by the first or second light.

In addition, the lamp 10 may further include a heat dissipation part 700 configured to receive heat generated from the first light source part 200 and the second light source part 500 and dissipate the heat to the outside. The heat dissipation part 700 may be configured to receive heat from the first light source part 200 and the second light source part 500 by means of heat exchange through thermal conduction and dissipate the heat to the outside. Meanwhile, the heat dissipation part 700 may be configured as a single body. In this case, there is an advantage in that the heat generated from the first light source part 200 and the heat generated from the second light source part 500 may be discharged at once through the single configuration (i.e., through the heat dissipation part 700 configured as a single body). In order to improve efficiency in dissipating heat through thermal conduction, the heat dissipation part 700 may be in direct contact with the first light source part 200 and the second light source part 500.

Figure 3:
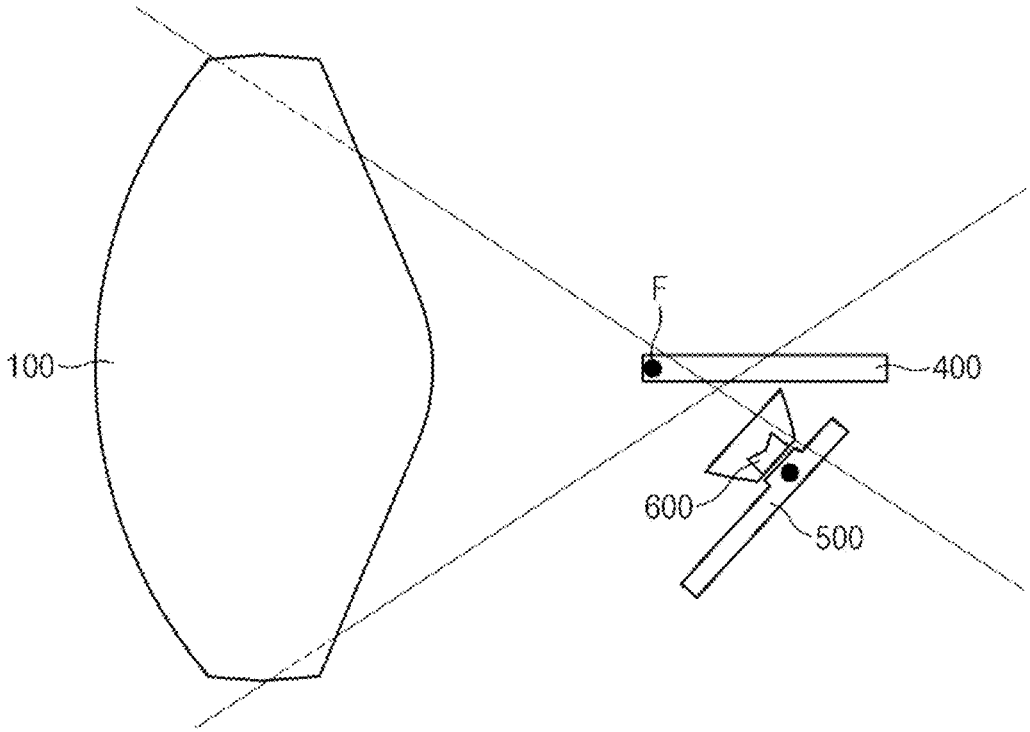
FIG. 3 is a side view illustrating relative positions between the lens part, a shield part, a second light source part, and an optic part in the lamp for a vehicle according to the present disclosure.
Figure 4:
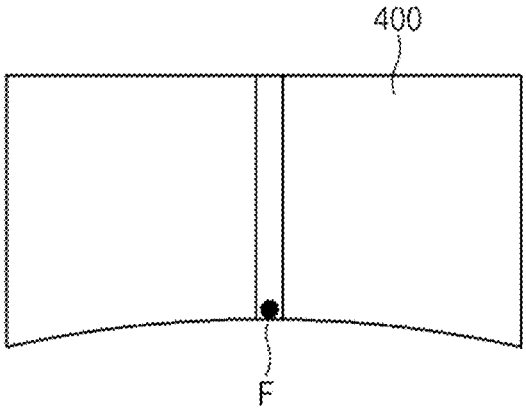
FIG. 4 is a top plan view illustrating a relative position between the shield part and a focal point of the lens part in the lamp for a vehicle according to the present disclosure.

FIG. 3 is a side view illustrating relative positions between the lens part, the shield part, the second light source part, and the optic part in the lamp for a vehicle according to the present disclosure, and FIG. 4 is a top plan view illustrating relative positions between the shield part and the focal point of the lens part in the lamp for a vehicle according to the present disclosure.

The lens part 100 may have the focal point as described above, and FIGS. 3 and 4 illustrate the focal point F of the lens part 100.

In this case, according to the present disclosure, a region of an outer surface of the shield part 400, which faces the lens part 100, may be provided between the lens part 100 and the focal point F of the lens part 100. The configuration in which the focal point of the lens part is provided between the outer surface of the shield part and the lens part may prevent light blindness (glare) caused by a part of the first light passing between the shield part and the focal point after being emitted from the first light source part. Therefore, according to the present disclosure, the first light and the second light, which are emitted from the first light source part 200 and the second light source part 500, respectively, may not reach the focal point F of the lens part 100. Alternatively, the region of the outer surface of the shield part 400, which faces the lens part 100, may be provided on the focal point F of the lens part 100. It is understood that the focal point F of the lens part 100 overlaps the outer surface of the shield part 400.

More particularly, as illustrated in FIGS. 3 and 4, the focal point F of the lens part 100 may be provided in the shield part 400, and the focal point F of the lens part 100 may be provided at a position corresponding to the region of the outer surface of the shield part 400 which faces the lens part 100. For example, as illustrated in FIG. 4, the focal point of the lens part 100 may be formed at the position corresponding to a central area in the region of the outer surface of the shield part 400 which faces the lens part 100.

Meanwhile, the lens part 100 of the lamp 10 according to the present disclosure may be configured as a single body as described above. In this case, the first light emitted from the first light source part 200 and the second light emitted from the second light source part 500 may reach the single body of the lens part 100, thereby forming beam patterns outside the vehicle.

According to the present disclosure, since the first light emitted from the first light source part 200 and the second light emitted from the second light source part 500 may reach the single lens part 100, it is possible to form various types of beam patterns outside the vehicle using the single lens part. In particular, as described above, the first light emitted from the first light source part 200 may form the low beam, and the second light emitted from the second light source part 500 may form the DRL. Therefore, according to the present disclosure, the single lens part 100 may be formed with the light emitting surface for forming the DRL as well as the light emitting surface for forming the low beam.

Continuing to refer to FIG. 3, the second light source part 500 may be provided below the focal point of the lens part 100, and the optic part 600 may also be provided below the focal point of the lens part 100. This configuration may be provided to allow the second light emitted from the second light source part 500 to reach an upper region of the lens part 100 in order to form the DRL.

In addition, as illustrated in FIG. 3, the second light source part 500 may be provided below the optic part 600, and the second light emitted from the second light source part 500 and entering the optic part 600 may have an optical path directed upward toward the lens part 100. Therefore, at least a part of the second light emitted from the second light source part 500 may be concentrated by the optic part 600, may exit the optic part 600, and then may enter the lens part 100 along the optical path directed upward straight.

Meanwhile, as illustrated in FIG. 3, the second light source part 500 and the optic part 600 may be provided below the shield part 400. More particularly, when viewing the shield part 400 from above the shield part 400, a region of the second light source part 500 in which the second light is generated and a region in which the optic part 600 is provided may overlap the shield part 400. It is understood that the optic part 600 and the region of the second light source part 500 in which the second light is generated are not visible with the naked eye when viewed from above the shield part 400.

The second light source part 500 may include the LED for generating the second light as described above, and the light emitted from the LED tends to spread out, unlike a laser for emitting light with high straightness. Therefore, if the region in which the second light is generated from the second light source part 500 and the region in which the optic part 600 is provided are provided behind the shield part 400, the optical path along which the second light reaches the lens part 100 is lengthened, which may cause a decrease in brightness of the beam pattern formed by the second light. In particular, the function of the DRL cannot be appropriately exhibited when the DRL is formed using the second light.

In contrast, according to the present disclosure, the region in which the second light is generated from the second light source part 500 and the region in which the optic part 600 is provided overlap the shield part 400 when viewing the shield part 400 from above the shield part 400. Accordingly, the optical path along which the second light reaches the lens part 100 is shortened, such that the brightness of the beam pattern formed by the second light may be improved, and the function of the DRL may be appropriately exhibited when the DRL is formed using the second light.

Meanwhile, a configuration in which the second light source part 500 for forming the second light is a laser may be considered. However, because the laser emits light with high straightness as described above, an area of a beam pattern formed outside the vehicle by the laser may also be narrow. Therefore, the laser may not be sufficient for application to the DRL that forms a comparatively wide beam pattern in an up-down or left-right direction in order to notify other drivers or pedestrians of the presence of the vehicle.

Figure 5:
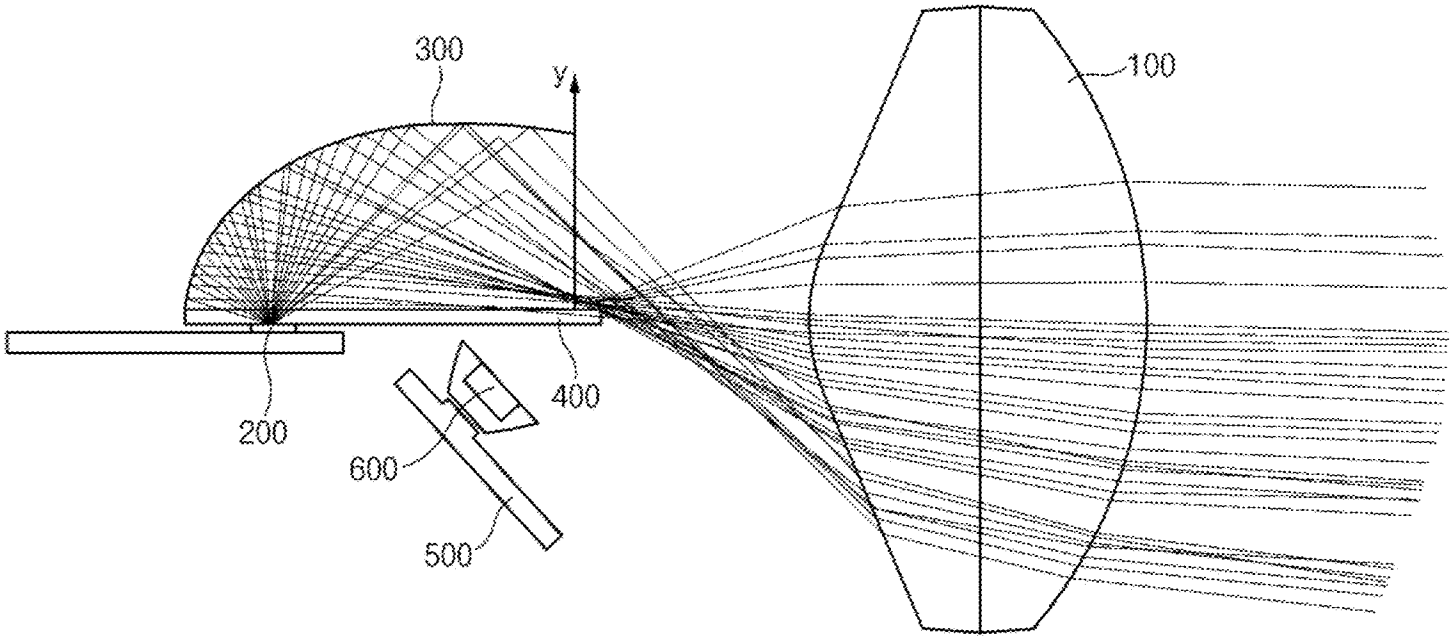
Figure 6:
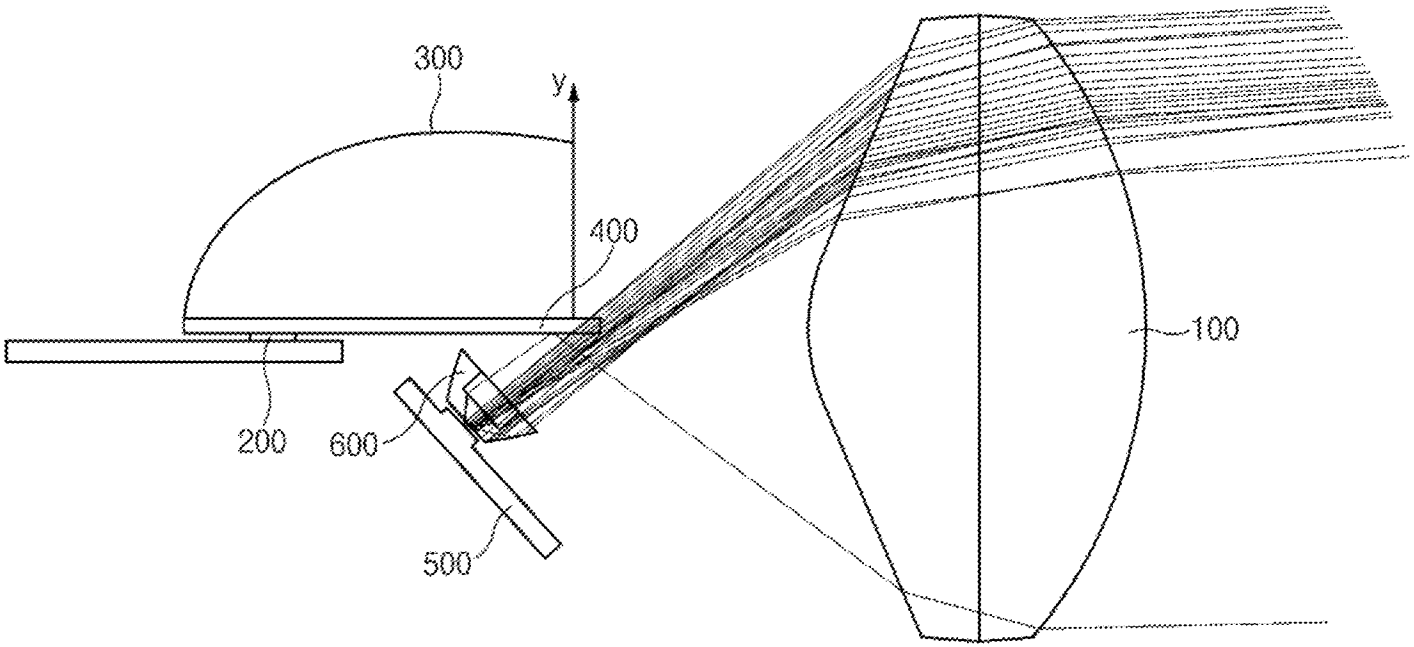

FIG. 5 is a side view illustrating a propagation direction of the first light when the first light source part of the lamp for a vehicle according to the present disclosure is turned on, and FIG. 6 is a side view illustrating a propagation direction of the second light when the second light source part of the lamp for a vehicle according to the present disclosure is turned on.

As illustrated in FIG. 5, when the first light source part 200 is turned on, the first light generated from the first light source part 200 is reflected by the reflector 300 and then reaches the lens part 100, thereby forming a beam pattern outside the vehicle. As illustrated in FIG. 5, the most part of the first light reflected by the reflector 300 may propagate straight as it is and then reach the lens part 100, but a part of the first light reflected by the reflector 300 may be reflected by the shield part 400 and then may reach the lens part 100. As illustrated in FIG. 5, the part of the first light, which is reflected by the shield part 400 and then reaches the lens part 100, is reflected by a region which is relatively lower in height than other regions of the reflector 300 (i.e., reflected by the region of the reflector 300 which is provided at the left side of the first light source part 200 based on FIG. 5). Therefore, the first light does not reach the upper region of the lens part 100 even though the part of the first light is reflected by the shield part 400. Accordingly, the low beam may be formed when the first light source part 200 is turned on.

In contrast, as illustrated in FIG. 6, when the second light source part 500 is turned on, the most part of the second light generated from the second light source part 500 may be concentrated by the optic part 600 and then may reach the upper region of the lens part 100 through the optical path directed upward straight. Accordingly, when the second light source part 500 is turned on, it is possible to form the DRL that serves to notify drivers in other vehicles or pedestrians of the presence of the vehicle during the daytime.

Vehicle

Hereinafter, a vehicle according to the present disclosure will be described with reference to the above-mentioned description and the drawings.

The vehicle according to the present disclosure may include the lamp for a vehicle. In this case, the lamp for a vehicle may include: the lens part 100 configured as the single body capable of transmitting light and having the focal point F; the first light source part 200 configured to generate the first light that is to enter the lens part 100; the second light source part 500 configured to generate the second light that is to enter the lens part 100; the optic part 600 provided in front of the second light source part 500 and configured to concentrate the second light emitted from the second light source part 500 and direct the second light to the lens part 100; and the shield part 400 configured to block a part of the first light or a part of the second light. In this case, the region of the outer surface of the shield part 400, which faces the lens part 100, may be provided between the lens part 100 and the focal point F of the lens part 100, and the first light emitted from the first light source part 200 and the second light emitted from the second light source part 500 may reach the single body of the lens part 100, thereby forming the beam pattern outside the vehicle. Meanwhile, the second light source part 500 may be provided below the focal point F of the lens part 100.

In addition, the first light emitted from the first light source part 200 may be the light for forming the low beam, and the second light emitted from the second light source part 500 may be the light for forming the daytime running light (DRL). Therefore, according to the present disclosure, when the first light source part 200 is turned on, the second light source part 500 may be turned off.

The present disclosure has been described with reference to the limited exemplary embodiments and the drawings, but the present disclosure is not limited thereto. The described exemplary embodiments may be carried out in various forms by those skilled in the art to which the present disclosure pertains within the technical spirit of the present disclosure and within the scope equivalent to the appended claims.

What is claimed is:

1. A lamp for a vehicle, the lamp comprising:

a lens part configured as a single body capable of transmitting light and having a focal point;

a first light source part configured to generate first light that is to enter the lens part;

a second light source part configured to generate second light that is to enter the lens part;

an optic part provided in front of the second light source part and configured to concentrate the second light emitted from the second light source part and direct the second light to the lens part;

a shield part configured to block a part of the first light or a part of the second light; and a heat dissipation part configured to receive heat generated from the first light source part and the second light source part and dissipate the heat, wherein a region of an outer surface of the shield part, which faces the lens part, is provided between the lens part and the focal point of the lens part, wherein the first light emitted from the first light source part and the second light emitted from the second light source part reach the single body of the lens part so as to form a beam pattern outside the vehicle, wherein the first light emitted from the first light source part is light for forming a low beam, the second light emitted from the second light source part is light for forming daytime running light (DRL), and the second light source part is turned off when the first light source part is turned on, wherein a first portion of the second light reaches the single body of the lens part without being reflected from the shield part, wherein a second portion of the second light reaches the single body of the lens part after being reflected from the shield part, wherein the heat dissipation part is configured as a single body, and wherein the heat dissipation part is in direct contact with the first light source part and the second light source part.

2. The lamp of claim 1, wherein the second light source part is provided below the focal point of the lens part.

3. The lamp of claim 1, further comprising:

a reflector provided above the first light source part, wherein at least a part of the first light emitted from the first light source part is reflected by the reflector and then enters the lens part, and wherein at least a part of the second light emitted from the second light source part is concentrated by the optic part, exits the optic part, and then enters the lens part along an optical path directed straight.

4. The lamp of claim 1, wherein the second light source part is provided below the optic part.

5. The lamp of claim 4, wherein the second light, which is emitted from the second light source part and enters the optic part, has an optical path directed upward toward the lens part.

6. The lamp of claim 1, wherein the optic part is provided below the focal point of the lens part.

7. The lamp of claim 1, wherein the second light source part and the optic part are provided below the shield part.

8. The lamp of claim 7, wherein a region of the second light source part in which the second light is generated and a region in which the optic part is provided overlap the shield part when viewing the shield part from above the shield part.

9. The lamp of claim 1, wherein the focal point of the lens part is formed at a position corresponding to the region of the outer surface of the shield part which faces the lens part.

10. The lamp of claim 1, wherein the second light source part comprises a light emitting diode (LED).

11. A vehicle comprising:

a lamp for a vehicle, the lamp comprising:

a lens part configured as a single body capable of transmitting light and having a focal point;

a first light source part configured to generate first light that is to enter the lens part;

a second light source part configured to generate second light that is to enter the lens part;

an optic part provided in front of the second light source part and configured to concentrate the second light emitted from the second light source part and direct the second light to the lens part;

a shield part configured to block a part of the first light or a part of the second light; and a heat dissipation part configured to receive heat generated from the first light source part and the second light source part and dissipate the heat, wherein a region of an outer surface of the shield part, which faces the lens part, is provided between the lens part and the focal point of the lens part, and wherein the first light emitted from the first light source part and the second light emitted from the second light source part reach the single body of the lens part so as to form a beam pattern outside the vehicle, wherein the first light emitted from the first light source part is light for forming a low beam, the second light emitted from the second light source part is light for forming daytime running light (DRL), and the second light source part is turned off when the first light source part is turned on, wherein a first portion of the second light reaches the single body of the lens part without being reflected from the shield part, wherein a second portion of the second light reaches the single body of the lens part after being reflected from the shield part, wherein the heat dissipation part is configured as a single body, and wherein the heat dissipation part is in direct contact with the first light source part and the second light source part.

12. The vehicle of claim 11, wherein the second light source part is provided below the focal point of the lens part.

* * * * *